United States Patent [19]

Dinges

[11] 4,285,182

[45] Aug. 25, 1981

[54] CONCEALED FASTENER PANEL CONSTRUCTION AND METHOD OF INSTALLATION

[75] Inventor: Kenneth N. Dinges, Tulsa, Okla.

[73] Assignee: Braden Steel Corporation, Tulsa, Okla.

[21] Appl. No.: 27,289

[22] Filed: Apr. 5, 1979

[51] Int. Cl.[3] ..... E04B 1/40; E04D 3/361

[52] U.S. Cl. ..... 52/478; 52/520; 52/543; 52/726; 52/748

[58] Field of Search ..... 52/478, 414, 713, 714, 52/726, 543, 544, 762, 773, 486, 488, 489, 520, 747, 748; 24/217 R

[56] References Cited

U.S. PATENT DOCUMENTS

| | | | |
|---|---|---|---|
| 1,714,682 | 5/1929 | Loucks | 52/773 |
| 2,232,510 | 2/1941 | Buckham | 52/488 |
| 2,295,444 | 9/1942 | Woodward | 24/217 |
| 2,653,686 | 9/1953 | Routt | 52/544 |
| 2,840,199 | 6/1958 | Marris | 52/726 |
| 3,716,958 | 2/1973 | Scrivener | 52/713 |
| 3,852,929 | 12/1974 | Cookson | 52/543 |
| 3,982,373 | 9/1976 | Wilson et al. | 52/588 |
| 4,063,396 | 12/1977 | Attaway | 52/520 |

*Primary Examiner*—James L. Ridgill, Jr

*Attorney, Agent, or Firm*—Harness, Dickey & Pierce

[57] ABSTRACT

A panel construction for roofs and walls of buildings incorporates holding clips secured to supporting roof purlins in overlying relation to locator strips which are installed preliminarily to establish the spacing of the clips. After the locating strips are positioned, the clips are temporarily located by interfitting portions of the strips and clips, whereafter permanent fasteners are extended through the clips and strips and into the supporting structural element. The clips are double bent sheet metal elements having integral latch-type retaining portions. The panels, of sheet material, have hollow upstanding dovetailed latching ribs extending longitudinally of medial areas thereof, and complemental partial latching rib portions along their longitudinal edges and which interlock in sealed engagement with the complemental partial rib portions of adjacent panels to define dovetailed latching ribs at the joints of the adjoining panels. The latching ribs are shaped to conform to the retaining portions of the clips and during assembly are snapped into latched relation with the clips by pressing on the ribbed portions of the panels.

16 Claims, 9 Drawing Figures

FIG. 1.
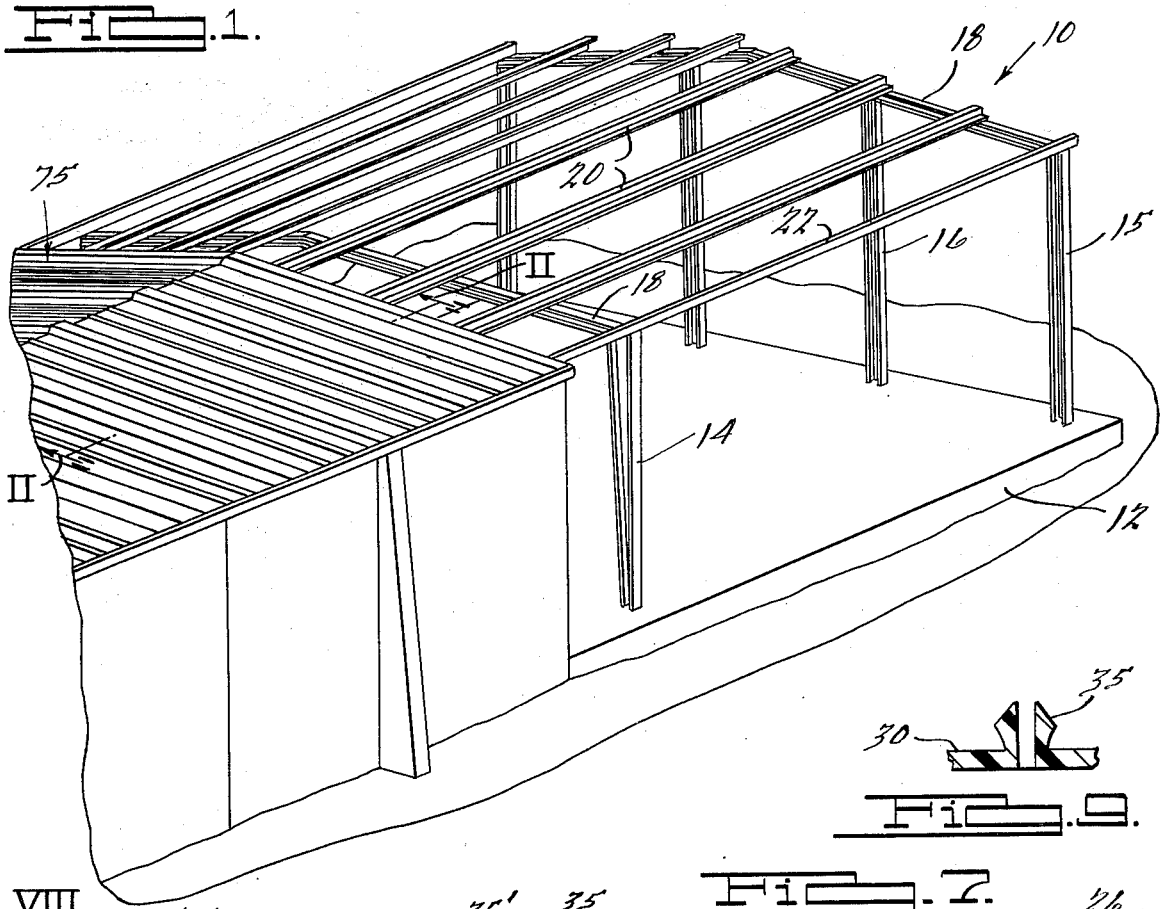
FIG. 9.
FIG. 7.
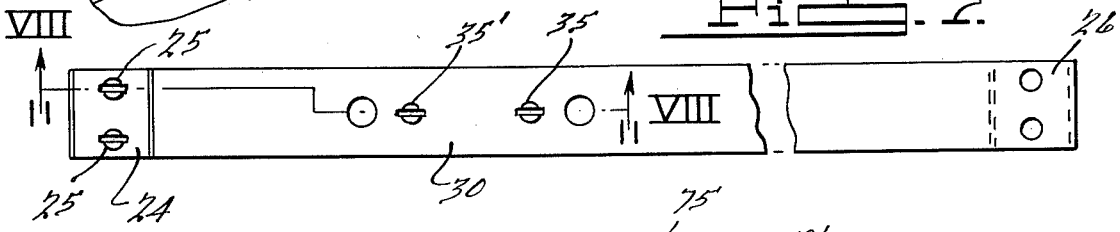
FIG. 3.
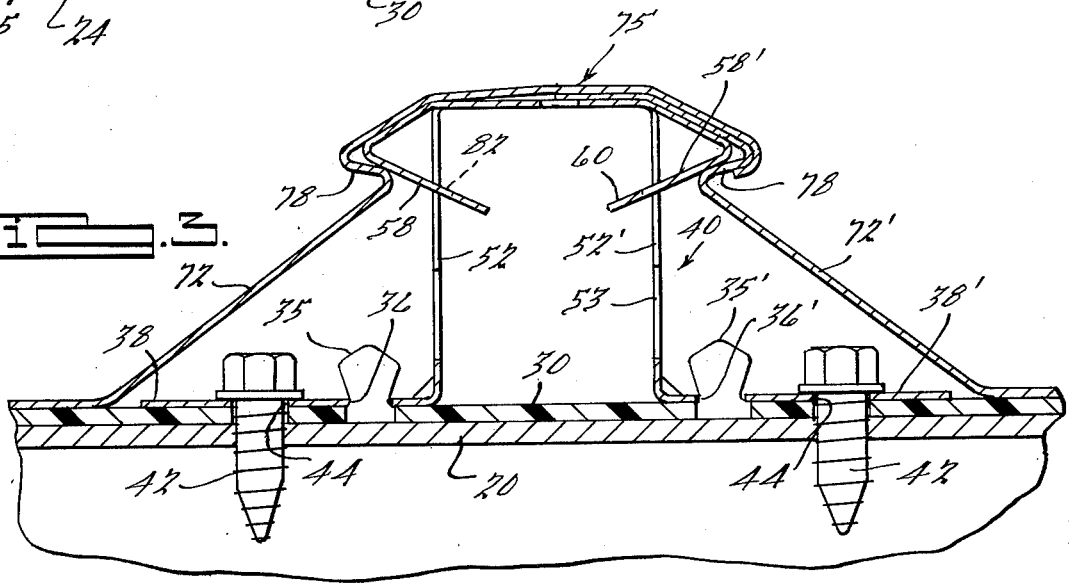

CONCEALED FASTENER PANEL CONSTRUCTION AND METHOD OF INSTALLATION

BACKGROUND OF THE INVENTION

The construction and installation of prefabricated panels in the roof and sidewall areas of building construction has been the object of much design effort, and a number of different designs have been commercially successful to varying degrees. The present invention relates to structures of the type wherein panels are preformed of sheet metal or other strong sheet material and are provided with longitudinal ribbing which forms a part of the retaining means for securing the panels to the building frame structure, such panels often being referred to as "standing seam" panels.

Building panels so designed as to be held entirely from beneath by fastening means which require no apertures in the panels and which provide a leakproof structure under the severe conditions encountered in roofing applications have been designed with standing seams which are deformed during installation of the panels to interlock the edges of adjacent panels and simultaneously interlock the seamed areas with underlying fastener clips preattached to the framing elements of the building. Although a number of such systems achieve satisfactory performance, many of them require that each workman be equipped with a heavy and expensive seam crimping machine which he must often manipulate on a roof under difficult conditions. The seaming machines are also typically slow, and involve dealing with an electrical supply cord. The design of the preformed seamable contours in the panels also frequently prevents efficient nesting of the panels for shipment. It will be appreciated that these disadvantageous factors have the net effect of adding to the cost of the finished structure.

Where seaming machines are used they also usually leave marks on the seams, which is of course undesireable when the panels are to be installed in areas which are readily visible, as in wall construction.

Preformed seam portions have also been used which are designed to be pounded together and onto underlying holding clips in the field by means of a rubber mallet. Due to the small size of such pounded seams, however, it is difficult to insure that they are fully interlocked, leakproof, and capable of withstanding the high lift off forces created by winds. Also, durinf installation almost all known panel designs present location or positioning problems in that a significant amount of time may be required to make sure that the anchoring means are properly spaced and/or that all through fasteners in fact pass through the supporting structure. Many prior standing seam designs also require a separate cap element. The present invention eliminates such problems and requires no cap.

With the foregoing in mind, it is the overall object of the present invention to provide an improved panel construction of the indicated character so designed that the panels can be secured to the attaching means which secures them to the frame structure merely by pressing the panels into place, which provides a panel structure which is very strong and highly resistant to the uplifting forces which are sometimes developed as a result of wind, yet which is effectively sealed and weathertight.

An object related to that stated is to provide such a panel construction which is not only low in first cost, but which incorporates improved prelocating and positioning means which makes the system inexpensive and quick to install. In roofing operations in accordance with this invention, the workmen can install the locating and fastening means for each successive panel, and the panel itself, while safely standing or kneeling on the preceding panel. Speed of installation and economy as well as safety, reliability and efficiency are also augmented by the fact that this invention permits the use of wider panels than can be employed with most prior systems, without sacrifice of strength or resistance to lift off, and by the fact that expansion and contraction of the panels due to temperature changes is accommodated by sliding of the panels relatively to the clips without generating harmful stresses.

Other objects and advantages will become apparent to persons skilled in the art upon consideration of the present disclosures in its entirety.

BRIEF DESCRIPTION OF THE FIGURES OF THE DRAWING

FIG. 1 is a somewhat diagrammatic perspective view of a partially completed building structure incorporating the principles of the present invention;

FIG. 7 is a plan view of a locating strip, centrally broken away;

FIG. 8 is a sectional view taken as indicated by the line VIII—VIII in FIG. 7, and FIG. 9 is an enlarged fragmentary detailed sectional view taken on the line IX—IX of FIG. 8.

DETAILED DESCRIPTION OF PREFERRED FORM OF THE INVENTION

Figures 2, 3, 4, 5, 6:
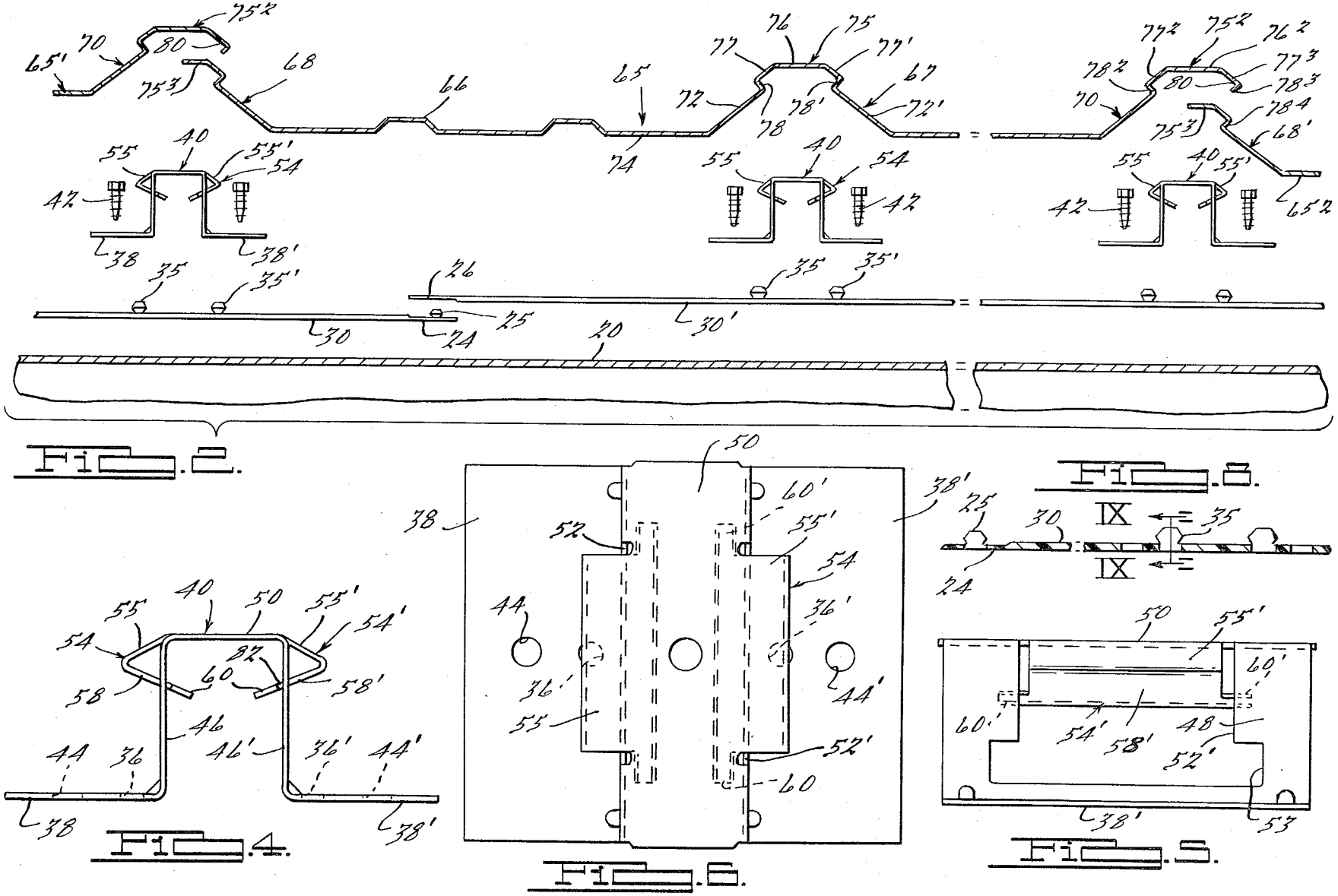
FIG. 2 is a fragmentary exploded sectional elevational view showing a position of a roof purlin in longitudinal section, and corresponding roof panel portions, also in section, with the corresponding locating strip members and securing portions separated vertically but in their relative longitudinal positions.
FIG. 3 is an enlarged detailed sectional view showing a portion of the completed assembly at the position of one of the hold down clips, taken centrally through the clip, at a position corresponding to that indicated by the line III—III in FIG. 5.
FIG. 4 is an end elevational view of one of the hold down clips.
FIG. 5 is a side elevational view of the hold down clip.
FIG. 6 is a top plan view thereof.

Although it will be recognized that the panel construction of the present invention is utilizable in the erection of walls, as well as for roofing, the typical construction to be described herein relates to roof structure. Those skilled in the art will appreciate that the principles can also readily be applied to wall structure.

Reference character 10 designates generally a portion of a utility building in course of construction. As is typical in such construction, a concrete slab as 12 may be provided, with upright steel side columns or posts 14, corner posts 15, and end posts 16. Additional studs (not shown) might of course to provided depending on the nature of the side wall construction. The posts carry arched roof supporting rafter elements 18 to which are attached the longitudinal roof purlins 20 and eave beam members 22. The purlins and eave beam members have flat tops, as is conventional.

To the top of each purlin and eave member a sectional locating strip assembly is applied, the construction of which is shown in FIGS. 2, 3, and 7–9. The locating strip sections, two of which are shown in FIG. 2, designated 30, 30', are formed of molded polypropylene in a suitable standardized length. End sections can of course be cut off when necessary. A standard length of 37 inches has been found convenient, with a width of one inch. At one end, shown at the right of section 30 in FIG. 2, the strips are reduced in thickness by recessing the top for a length of about one inch, as indicated at 24. Upstanding from such thinned portion 24 are snap lock buttons 25 integrally molded thereon and adapted to be overfitted by and to retain a conformably apertured bottom recessed thinned portion 26 of the adjacent strip member 30' to couple the strips together. At intermediate positions along each of strips as 30, 30', pairs of snap buttons as 35, 35' are molded in uniformly spaced pairs. The spacing of the buttons 35, 35' of each such pair is standardized to conform to the spacing of holes 36, 36' in the base flanges 38, 38' of supporting bracket 40.

As brought out in FIG. 2, the brackets 40 are adapted to be spaced at desired distances along the purlins and eave members by means of the strips 30, 30', which, through the agency of the buttons 35, 35', serve as locating members for the brackets. The strips 30, 30' etc. are adapted to be coupled together to form the desired length of stripping, conforming to the length of the purlin or frame member to be paneled, by means of the end buttons 25 and apertured portions 26. The brackets 40 are then snapped on the buttons 35, 35', and thereby located in the desired positions, and thereafter the brackets are securely and permanently fastened to the purlins and eave members as by means of heavy self-drilling, self-tapping screws 42 inserted through holes 44, 44' in bracket flanges 38, 38', and into the purlins or other supporting frame members.

As shown in detail in FIGS. 4–6, the brackets are basically of double-bent form. The spaced parallel upstanding sidewall portions 46, 46' extend upwardly from the respective flanges 38, 38', and are joined by the integral top web or wall 50. Each of the side webs 46, 46' is pierced to form an opening 52, 52' of generally inverted T form and to define a latching tongue 54, 54', the outline of which is similar to that of opening 52 or 52' but sufficiently smaller to be movable laterally in the opening. Tongues 54, 54' are bent to form an upper leg 55, 55', which constitutes an outwardly and downwardly sloping integral continuation of top web 50, and an integral inwardly rebent downwardly and inwardly sloping leg 58, 58', which extends back through the opening 52. At the lateral ends of the legs 58, 58' of each tongue 54, 54' an integral stop lug portion as 60, 60' is provided which projects behind the unpierced sidewall portion 46, 46' in the narrower upper portion of the opening 52, 52'.

As shown in FIG. 3, the brackets 40 are attached to the purlins or other frame members as 20 with the flat side walls 46, 46', thereof extending transversely. FIG. 2 shows one of the roof panels, generally designated 65, and portions of two adjacent panels 65', and 65². Each panel has straight longitudinal ribbing extending its full length and which consists, in addition to simple stiffening ribs as 66, of one or more relatively large upstanding securing ribs 67 extending longitudinally of a mid portion of each panel, and incomplete securing rib portions 68, 70 parallel thereto along the side edges of the panel. The ribs 67 are of a height and width sufficient to cover the brackets 40, as best shown in FIG. 3. Each rib 67 consists of two upwardly sloping converging walls, 72, 72', rising from the flat main portions 74 which define the base plane of the panel to a head portion of generally mushroom shaped cross section generally designated 75, having a flat top 76, the width of which conforms to the width of the flat top portion 50 of the brackets 40. Integral outwardly and downwardly sloping wall portions 77, 77' of head 75 conform to and are adapted to closely overlie the latching arm portions 55, 55' of the brackets which the panel is applied to. Beneath the portions 77, 77', and joining them to the sloping walls 72, 72' respectively are integral downwardly and inwardly sloping wall portions 78, 78' which are adapted to underengage the bottom latching arm portions 58, 58' of the brackets, as best shown in FIG. 3. Along one edge, shown at the left of the central panel 65 in FIG. 2, an incomplete rib 68 has a head 75³ shaped similarly and corresponding to approximately the right half of the complete medial rib 67. The incomplete ribs 70 shown extending along the right hand edges of the panels 65 and 65' incorporate a top portion 75² having portions 76², 77³, 78³ adapted to fit over and complete a seal with the incomplete rib portion as 68, 68' of an adjacent panel and to be interengaged with the incomplete head portion 75³ thereof. In order to eliminate any possibility of leakage, a sealing compound 80 may be placed inside the incomplete female rib portion 75² in the region of wall portions 77³, 78³ thereof.

In installing the panel structure on a roof, after the brackets are applied in the manner described above, the panels are laid thereover in the relative positioning shown in FIG. 2, and the panels can then be pressed into place simply by stepping on them at the positions overlying the brackets. In the case of the two-part rib structures at the edges of the panels, the overlying part as 75² snaps over the underlying rib portion as 75³. As the composite edge rib is pushed down by pressure on top portion 75², the latching arm portions 55, 55' are forced downwardly and inwardly until the inbent wall portions 78², 78³, 78⁴ snap over the lower inbent latching arm portions 58, 58'. The inclination of these parts and the strength of the materials are such that no wind or suction force which the building could be expected to withstand could pull the panels free. In this connection it will be noted that the lug portions 60, 60' on the latching arms lie close to the inner surfaces of the sidewalls 46, 46' of the brackets and prevent the latching arms from bending upwardly, so that in order to pull free it would be necessary either for the panels to be greatly distorted, or the lugs 60, 60' be broken. In normal positioning some clearance 82 is provided between the lugs and sidewalls of the brackets, however, to accommodate expansion.

As brought out in FIG. 2 the panels as typified by panel 65 are wide enough to span three clips. They may be wider or narrower, as may be best suited for particular uses, but it should be noted that the present invenion makes it feasible to employ relatively wide panels spanning three or more clips and having medial holding rib portions as 75 which are effective to hold the medial portions of the panels against lifting forces.

In installing roof panels in accordance with this invention no tools are required other than a screwdriver. The locating strips and clips for the first panel are normally installed at one end of the roof with the aid of a ladder, the locating strips being automatically securely and accurately positioned as soon as the screws 42 are driven to hold the first bracket and strip on each purlin. All brackets needed for the first panel are installed in this manner. Thereafter the first panel is laid in place and can be attached simply by stamping with the foot on the securing rib portions at positions overlying the clips, as noted above. Th workman can then stand or sit on the installed panel and reach out over the purlins to install the holding elements for and position the next panel, and continue in the same manner for the full length of the roof. Rapid and economical installation is facilitated by the fact that workmen are not required to stand and work on the purlins or framing structure.

All of the interengaging holding surfaces of the ribs and clips are straight and parallel. The panels are thus capable of longitudinal sliding movement with relation to the clips to accommodate expansion and contraction due to temperature changes.

Where the installation is on a vertical or very steep surface, a rubber mallet may of course be used to force the panels to the latched condition.

It will also be understood that the panel holding clips can be preattached to the locating strips, either at the factory or on the job.

This Detailed Description of the Preferred Form of the Invention and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent and Trademark Office.

While a preferred embodiment of the invention has been described herein, it will be appreciated that various modifications and changes may be made without departing from the spirit and scope of the appended claims.

What is claimed is:

1. Securing means for the panels of a building panel structure comprising elongated relatively thin flat locating strips having coupling portions at their ends for assembling a plurality of such strips to a desired length, said strips being adapted to be installed in end to end relation lengthwise upon an elongated building frmae member, clip locating portions on surface portions of said strips which remain exposed when the strips are so installed, said clip locating portions being arranged at standardized longitudinally spaced distances, panel holding clips having base portions for attaching the same to supporting structure, additional locating portions on said base portions adapted to interfit with said clip locating portions on the locating strips, fastener-receiving portions on the base portions adapted for securance to an underlying building frame member by fastening means extending through such base portions and through the underlying locating strips and into the building frame member, and flexible latching means on said clips adapted for interengagement with coacting latching means on overlying panels.

2. Securing means as defined in claim 1 wherein each of said clips comprises a sheet metal member having an upstanding frame portion of inverted U-section defined by a top wall and substantially flat side walls, base flanges extending laterally from the lower extremities of said side walls and defining said base portions, and a pair of integral flexible latching arm portions, each of said latching arm portions being biased to and normally standing in a position extending angularly outwardly and downwardly from one of said side walls, said latching arm portions being pierced from said side walls, integral continuation latching arm portions extending inwardly and downwardly from the first mentioned latching arm portions, and coacting abutment means on said arm portions and side walls limiting outward movement of said continuation latching arm portions in directions away from said side walls.

3. Means as defined in claim 2 wherein said continuation latching arm portions extend inwardly through said side walls, said means limiting outward movement comprising abutments on each of said continuation latching arm portions in the space between the side walls underlapping coacting abutment portions carried by the side walls.

4. Means as defined in claim 2 wherein each of said continuation latching arm portions extends inwardly through the side wall, and lug portions on said continuation latching arm portions underhanging the side wall and engageable with the inner surfaces of the side walls to limit outward and upward movement of the latching arm portions.

5. A panel holding clip construction comprising a sheet metal member having an upstanding frame portion of generally inverted U-section defined by a top wall and side walls, base flanges extending laterally from the lower extremities of said side walls, a head including a pair of integral flexible latching arm portions, each of said latching arm portions being biased to and normally standing in a position extending angularly outwardly and downwardly from one of said side walls, said latching arm portions being pierced from said side walls, integral continuation latching arm portions extending inwardly and downwardly from the first mentioned latching arm portions, and abutment means on said side walls and latching arm portions limiting outward movement of said continuation latching arm portions in directions away from said side walls.

6. A construction as defined in claim 5 wherein said abutment means limiting outward movement comprises an abutment on each of said continuation latching arm portions underlapping a coacting abutment portion carried by the side wall.

7. Means as defined in claim 5 wherein each of said continuation latching arm portions extends inwardly through the side wall, said abutment means including lug portions on said continuation latching arm portions underhanging the side wall and engageable with the inner surfaces of the side walls to limit outward and upward movement of the latching arm portions.

8. A holding clip for building panels and the like comprising a sheet metal member having a base portion adapted to be attached to supporting structure and having a retaining head of generally mushroom-shaped cross section defined by oppositely laterally protruding latching portions which are resiliently inwardly deflectable toward each other and which extend along lines parallel to each other, each said latching portion comprising a first leg extending outwardly from said clip and an integrally formed second leg extending inwardly toward said clip, said legs joining one another along a generally straight line of intersection, the lines of intersection of both latching portions being generally parallel to one another.

9. In combination with the clip of claim 8, a building panel of sheet form having an integral impervious upstanding rib defining a channel having top and side walls and adapted to over-engage a plurality of said panel holding clips, said channel having reentrant wall portions interengageable with said latching portions on such clips to be retained thereby.

10. Means as defined in claim 9 wherein each of said ribs has wall diverging angularly outwardly and downwardly from the top wall above and integral with said reentrant wall portions, and rediverging walls below said reentrant wall portions, the rediverging walls being adapted to deflect inwardly said latching portions of the head, the reentrant wall portions being proportioned to underlie said latching portions.

11. Means for securing panel elements to elongated building frame members comprising elongated relatively thin flat locating strips having coupling portions at their ends for assembling a plurality of such strips to a desired length, said strips being adapted to be installed lengthwise in end to end coupled relation upon a building frame member, clip locating portions on surface portions of said strips which remain exposed when the strips are so installed, said clip locating portions being arranged at standardized longitudinally space distance, whereby panel holding clips may be located on frame members and secured thereto in overlying relation to such strips, to enable retention of panel elements upon the frame member, said locating strips being formed of material having relatively low heat conductivity.

12. A panel holding clip construction comprising a sheet metal member having an upstanding frame portion of generally inverted U-section defined by a top wall and side walls, a base flange extending laterally from the lower extremities of one of said side walls, a head including a pair of integral flexible latching arm portions, each of said latching arm portions normally standing in a position extending angularly outwardly from one of said side walls, and limit means integral with said clip for limiting the maximum outward deflection of said latching arm portions.

13. A construction as defined in claim 12, including integral continuation latching arm portions extending inwardly and downwardly from the first mentioned latching arm portions, said limit means limiting outward movement of said continuation latching arm portions in directions away from said side walls.

14. A construction as defined in claim 13, wherein said latching arm portions and continuation latching arm portions are pierced from said side walls.

15. A construction as defined in claim 13, wherein said limit means comprises an abutment on each of said continuation latching arm portions underlapping a coacting abutment portion carried by the side wall.

16. The method of attaching to the elongated structural elements of a building or the like a panel having latchable retaining portions on its under surface, said latchable retaining portions including downwardly opening hollow ribs of generally mushroom-shaped cross section extending longitudinally of a medial portion of each panel, and also including partial ribs of corresponding cross section on the edges of each panel and which are interfittable with cooperating partial ribs of adjacent panels to define complete ribs of like cross section, which method comprises: positioning lengthwise on each such structural element an elongated locating strip; securing a latching type panel holding clip to each such structural element in overlying relation to the locating strip to fasten both the clip and the strip to the structural element; forcing latchable retaining portions on the panel into latched holding engagement with the underlying panel holding clips by pressure exerted on the top surface of the panel; attaching additional locating strips to end portions of the previously installed strips to form extention of the latter lying on and along such structural elements; securing additional panel holding clips to the structural elements in overlying relation to said additional locating strips; placing a second panel over such additional clips with the partial rib on the edge of the second panel interfitted with a partial rib on the first mentioned panel; and thereafter forcing the rib defined by said interfitted partial ribs, and said medial rib of the second panel, into holding engagement with the underlying panel holding clips by pressure on top surfaces of the panels in like fashion.

* * * * *